US007896757B2

(12) United States Patent
Horkan

(10) Patent No.: US 7,896,757 B2
(45) Date of Patent: Mar. 1, 2011

(54) FOOTBALL CENTER TRAINING AID

(76) Inventor: Noel P. Horkan, New Windsor, NY (US)

( * ) Notice: Subject to any disclaimer, the term of this patent is extended or adjusted under 35 U.S.C. 154(b) by 92 days.

(21) Appl. No.: 11/581,135

(22) Filed: Oct. 14, 2006

(65) Prior Publication Data

US 2008/0090680 A1 Apr. 17, 2008

(51) Int. Cl.
*A63B 69/00* (2006.01)

(52) U.S. Cl. ..... 473/438; 473/422

(58) Field of Classification Search ..... 473/422, 473/438, 440, 441; 135/125, 126; 472/62; 482/35

See application file for complete search history.

(56) References Cited

U.S. PATENT DOCUMENTS 1,940,147 A * 12/1933 Sankus ..... 135/157
3,578,323 A * 5/1971 Coleman et al. ..... 473/438
3,604,439 A * 9/1971 Thomka ..... 135/136
4,218,060 A * 8/1980 Forrest ..... 473/438
4,629,182 A * 12/1986 Rader et al. ..... 482/35
4,688,795 A * 8/1987 Callaway, Jr. ..... 473/438
5,516,115 A * 5/1996 McLain ..... 473/417
5,618,246 A * 4/1997 Zheng ..... 482/35
6,283,876 B1 * 9/2001 Northcutt ..... 473/422
6,289,910 B1 * 9/2001 Zheng ..... 135/125
6,494,224 B2 * 12/2002 Zheng ..... 135/125
7,219,681 B1 * 5/2007 Hamilton-Jones ..... 135/123

* cited by examiner

*Primary Examiner*—Mitra Aryanpour
(74) *Attorney, Agent, or Firm*—James Russell Claybrook

(57) ABSTRACT

A football center training aid comprises a box-like training device in the form of a framework, covered on its top and sides with open-mesh netting, which provides a guide to encourage accurate passing of a football by a center to a place-kick holder or quarterback, and which allows observation by a coach or trainer of the passing action of the center. The device encourages the preferred distance and alignment of the center in relation to the place-kick holder or quarterback. The device is readily portable, and may optionally be adjustable in both height and length to adapt the dimensions to players of differing ages, sizes, and to differing training objectives. The device allows the complete actions of passing the football by a center and catching by a place-kick holder or quarterback, and complete observation of the action, so that a complete and realistic assessment of the effectiveness of the passing action may be made by the coach or trainer, and corrective actions immediately taken and assessed.

11 Claims, 4 Drawing Sheets

FOOTBALL CENTER TRAINING AID

BACKGROUND OF THE INVENTION

This invention relates to a training aid for the game of football, and, more particularly, to a device which assists in teaching a player in the position of center, to correctly pass a football to another player in the position of place-kick holder or quarterback.

The effective passing of a football, by a player assigned to the position of center, to a player assigned to the position of place-kick holder or quarterback, is not always readily learned, particularly in the case of a young or novice football player. A football play from scrimmage is initiated by a snap of the football by the center, either as a direct handoff to the quarterback who is located immediately behind the center, or as a pass to a place-kick holder or the quarterback who is located several feet behind the center. At the instant that the center begins to pass the football to the place-kick holder or quarterback, the football play is initiated and the players of the opposing team may, and normally do, vigorously rush forward, contacting the center and other players in the center's team, with the intention of disrupting and interfering with the accurate passing of the football by the center to the place-kick holder or quarterback, and with the planned action of the place-kick holder or quarterback after receiving the football. In the case of the location of the place-kick holder or quarterback several feet behind the center, at the initiation of the football play, the center's pass must be forcefully and accurately directed to the place-kick holder or quarterback, to maximize the ability of the place-kick holder or quarterback to catch and control the football and immediately take the planned action, and to minimize the ability of the opposing players to disrupt or interfere with the place-kick holder's or quarterback's control of the football and successful execution of the planned action. The extremely rapid and diverse sequence of actions by the center's team and the opposing team, and the vigorous actions of the opposing team, make effective training and practice essential to the preparation of the center for the crucial activity of accurate passing of the football to the place-kick holder or quarterback. The most effective training and practice requires that the football be passed to a player serving the role of place-kick holder or quarterback, in order that the trajectory, accuracy and force of the pass can be directly and realistically assessed. Preferably, the trajectory is nearly straight rather than substantially arched, the football is aimed accurately at the hands of the place-kick holder or quarterback and the force is in the range most appropriate for the football to be readily caught by the place-kick holder or quarterback. Accordingly, it is desirable to present a training aid which urges an accurate passing action by the center, and facilitates observation by a coach or trainer of the trajectory, accuracy and force of each pass, to enable self-correction and effective guidance by coaches and trainers.

Known prior art devices have not successfully addressed the above problems. Various patents disclose devices and complex apparatus designed to provide targets for actions in football and other sports, in which accuracy is assessed by the projectile striking a target, which may include a bag or similar structure to capture the projectile. Such devices and apparatus do not provide the opportunity for the accuracy and effectiveness of the pass to be realistically assessed, by the ability of a second player serving the role of place-kick holder or quarterback to catch the football. Realistic assessment of the accuracy and effectiveness of a center pass requires that a second player have the opportunity to attempt to catch the pass, which cannot be provided if the football strikes a target or is captured by the device. Such devices also do not encourage the preferred location and alignment of the center in relation to the second player, do not provide realistic framing of a target area corresponding to the preferred trajectory of a center pass in the game of football, and do not provide immediate feedback regarding substantial inaccuracy of the pass by having a surface which the football strikes in the event of such inaccuracy. (U.S. Pat. No. 4,068,846; U.S. Pat. No. 4,239,235; U.S. Pat. No. 4,826,166; U.S. Pat. No. 4,836,542; U.S. Pat. No. 4,932,657). U.S. Patent Application No. US2005/0192126 A1 discloses a training device which presents a net at a height and configuration resembling a basketball net, which does not require a center's pass to follow the trajectory required in a normal center pass to the quarterback; further, the disclosed device does not permit a second player serving the role of place-kick holder or quarterback to receive the pass and thus assess its effectiveness.

BRIEF SUMMARY OF THE INVENTION

In response to the needs described I have invented a box-like training device in the form of a framework, covered on its top and sides with open-mesh netting, which provides a guide to encourage accurate passing of a football by a center to a place-kick holder or quarterback, and which allows observation by a coach or trainer of the passing action of the center. The device encourages the preferred distance and alignment of the center in relation to the place-kick holder or quarterback. The device is readily portable, and may optionally be adjustable in both height and length to adapt the dimensions to players of differing ages and sizes and to differing training objectives. The device allows the complete actions of passing the football by a center and catching by a place-kick holder or quarterback to be observed by a coach or trainer, so that a complete and realistic assessment of the effectiveness of the passing action may be made by the coach or trainer, and corrective actions immediately taken and assessed.

It is therefore a general object of this invention to provide a training aid in the form of a device which permits and encourages a realistic passing of a football, by a player in the role of center, to a player in the role of place-kick holder or quarterback.

A further object of this invention is to provide a training aid, as aforesaid, which allows unobstructed observation of the passing action by a coach or trainer.

Still another object of this invention is to provide a training aid, as aforesaid, which is readily portable.

Still another object of this invention is to provide a training aid, as aforesaid, which is adjustable in height, to allow adaptation to players of different ages or sizes, and to different training objectives.

Still another object of this invention is to provide a training aid, as aforesaid, which is adjustable in length, to allow adaptation to players of different ages or sizes, and to different training objectives.

Still another object of this invention is to provide a training aid, as aforesaid, which provides visual cues to encourage a center and a place-kick holder or quarterback to position themselves in the preferred locations and alignment in preparation for the passing action.

Still another object of this invention is to provide a method of training of players in the role of center, to effectively pass a football to a place-kick holder or quarterback, by use of the aforesaid device.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
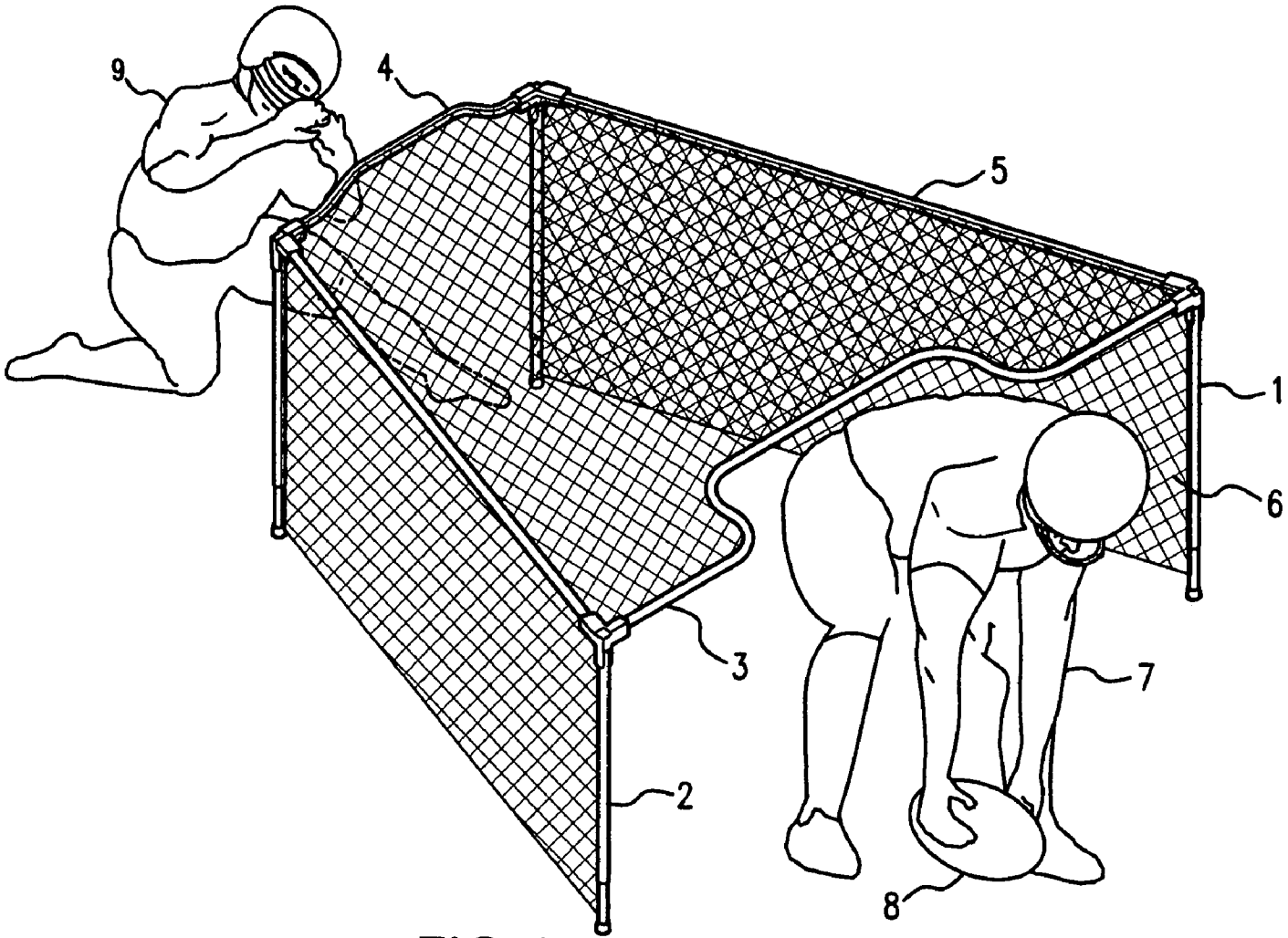
FIG. 1 is a perspective view showing a first player (7) in the role of a football center, in position to pass (center) a football (8) through the training aid (1) to a second player (9). The training aid is a box-like framework with vertical supports (2), and horizontal supports including a front support (3); a rear support (4) and side supports (5). The side and top openings of the framework are covered by an open mesh netting (6), while the front and rear openings are uncovered to allow passing of the football.

Turning more particularly to the drawings, FIG. 1 shows the training device (1) and a first player (7) in the role of a football center, positioned near the front of the device and grasping a football (8) in preparation for passing the football through the device to a second player (9) in the role of a place-kick holder, positioned near the rear of the device, and prepared to catch the football.

Figure 2:
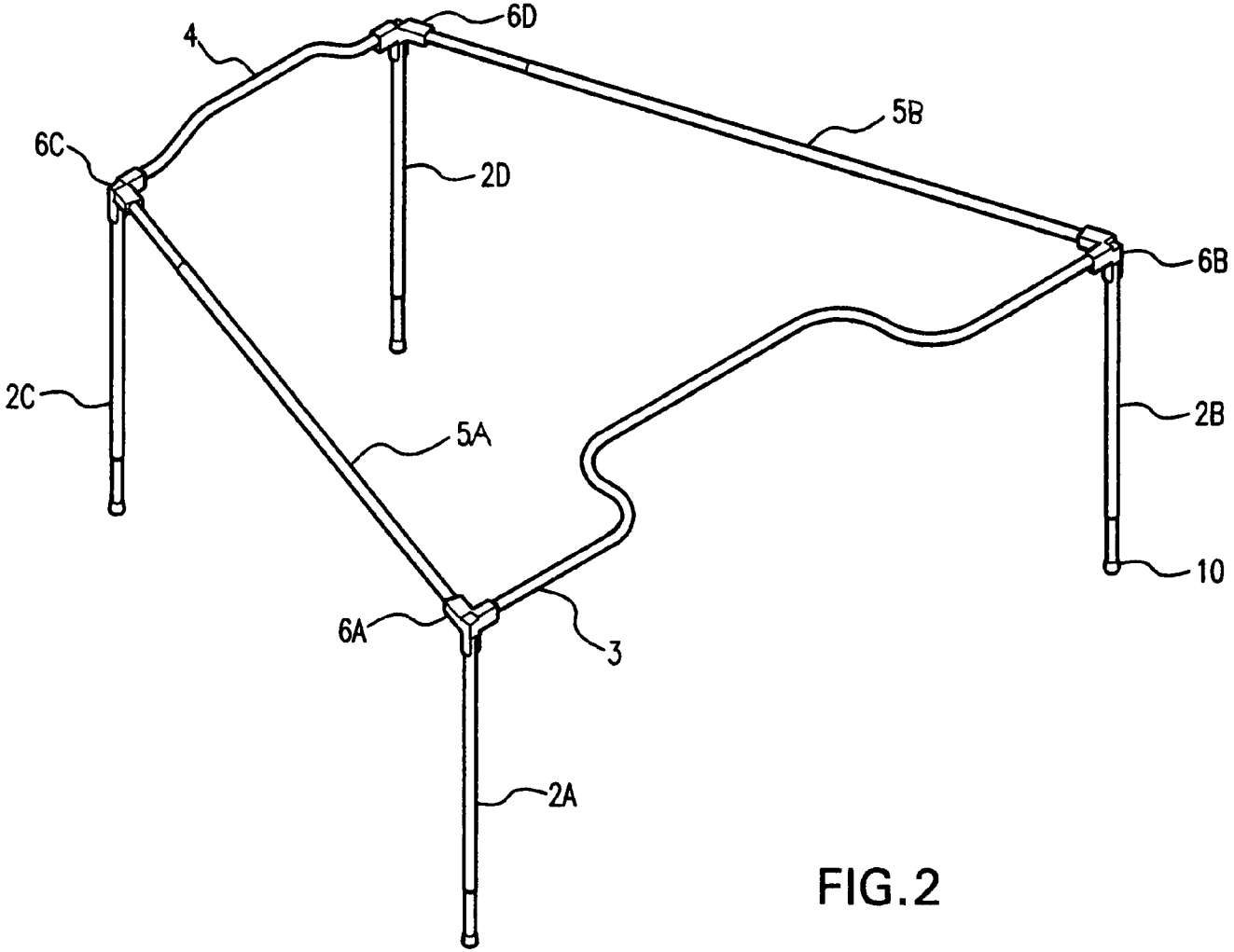
FIG. 2 is a perspective view of the framework showing first (2A) and second (2B) front vertical supports, first (2C) and second (2D) rear vertical supports, front (3) and rear (4) horizontal supports, first (5A) and second (5B) side horizontal supports, first (6A) and second (6B) front angular couplings, first (6C) and second (6D) rear angular couplings and protective caps (10).

FIG. 1 also shows the box-like, essentially rectilinear framework of the device, including rigid vertical support rods (2) and rigid horizontal support rods (3, 4, 5) removably joined by angular couplings, and open mesh net cover (6) covering the side and top openings of the framework FIG. 2 shows the framework of the device, including four vertical support rods having upper and lower ends, removably joined to four horizontal support rods having first and second ends, at the upper ends of the vertical support rods by four angular couplings, The vertical support rods include two front support rods, a first front vertical support rod (2A) and second front vertical support rod (2B), and two rear support rods, a first rear vertical support rod (2C) and second rear vertical support rod (2D). The lengths of the vertical support rods are adjustable, so that the height of the horizontal support rods from the playing surface can be varied as desired according to the sizes and ages of the players, and the training objectives. FIG. 2 also shows the four horizontal support rods, including front (3) and rear (4) horizontal support rods, and first (5A) and second (5B) side horizontal support rods. The front horizontal support rod (3) can be straight, or the mid-section can be recessed in the horizontal plane, as shown in FIG. 2, to provide a niche to aid the first player in taking the desired position. The rear horizontal support rod (4) can be straight, or the mid-section can be elevated in the vertical plane to provide a niche to aid the second player in taking the desired position. The first (5A) and second (5B) side horizontal support rods are adjustable so that the front-to rear length of the device can be adjusted, as desired according to the sizes and ages of the players and the training objectives.

FIG. 2 also shows the four angular couplings removably joining the vertical and horizontal support rods, in the desired angular positions. The first (6A) and second (6B) front angular couplings join the front vertical support rod (3) to the first (2A) and second (2B) front vertical support rods, and the first (6C) and second (6D) rear angular couplings join the rear horizontal support rod (4) to the first (2C) and second (6D) rear vertical support rods. The vertical and horizontal support rods can be readily removed from the angular couplings, so that the device can be disassembled for portability. The lower ends of the vertical support rods can be fitted with protective caps (10), to protect the lower ends from abrasion and soiling by the playing surface.

Figure 3:
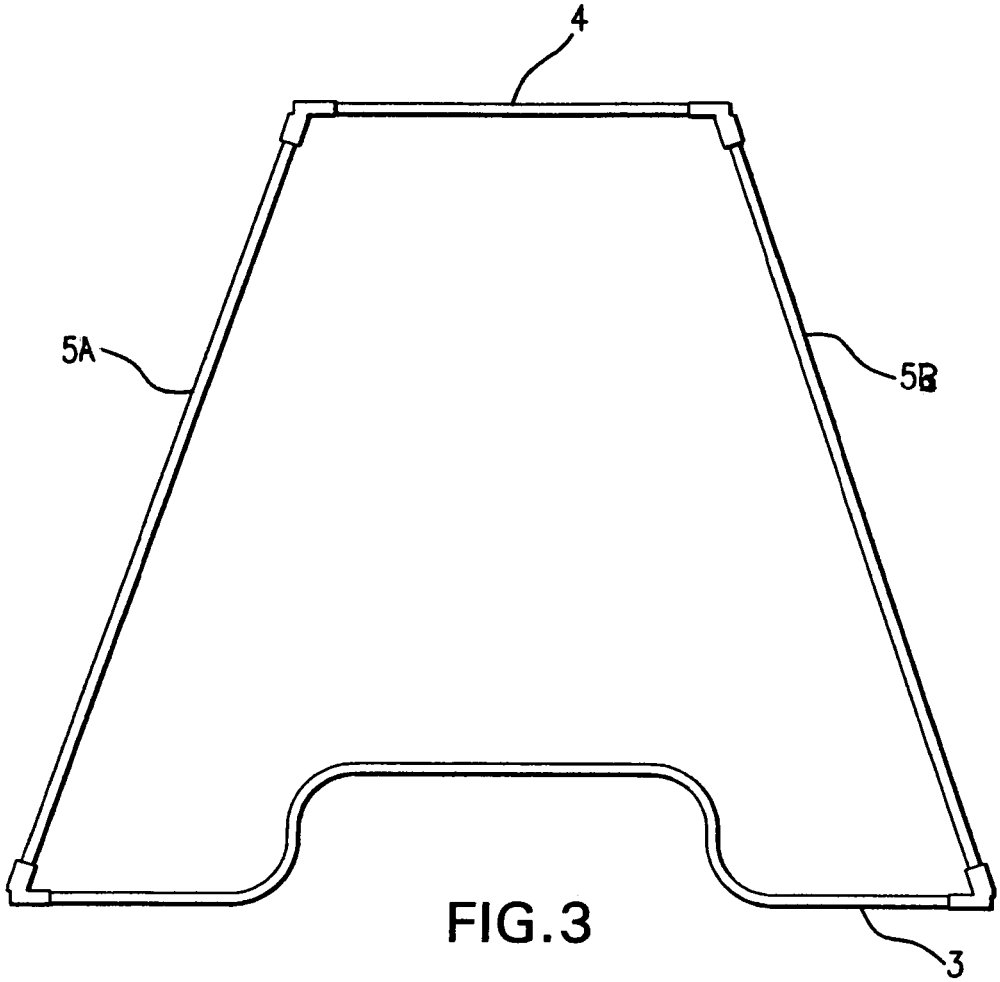
FIG. 3 is a plan view showing the top of the framework including front (3) and rear (4) horizontal supports, and first (5A) and second (5B) side horizontal supports.

FIG. 3 shows the top of the framework including front (3) and rear (4) horizontal supports, first (5A) and second (5B) side horizontal supports, first (6A) and second (6B) front angular couplings and first (6C) and second (6D) rear angular couplings. The front horizontal support (3) can be straight, or the mid-section can be recessed in the horizontal plane, as shown in FIG. 3, to provide a niche to aid the center in taking the desired position.

Figure 4:
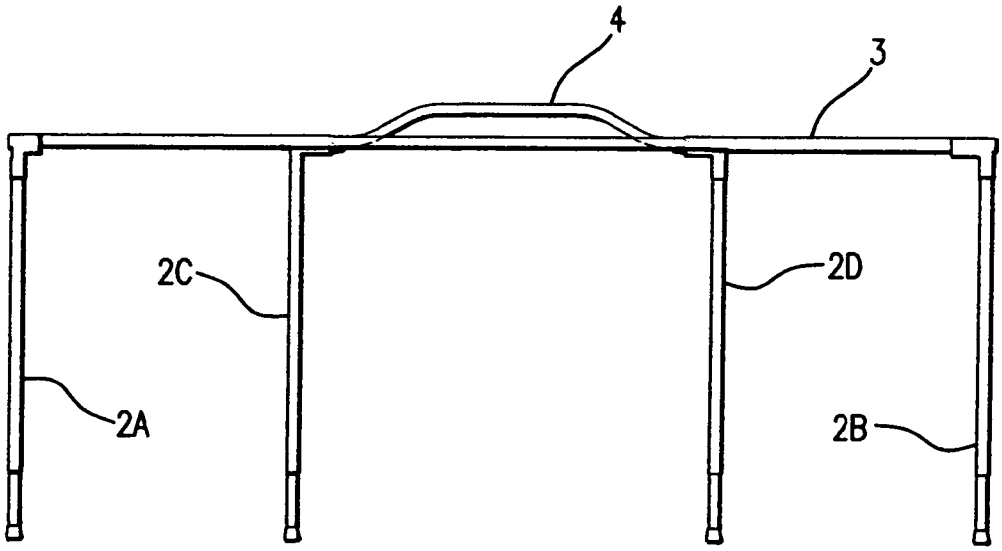
FIG. 4 is a front elevation view of the framework showing the first (2A) and second (2B) front vertical supports, first (2C) and second (2D) rear vertical supports, front horizontal support (3) and rear horizontal support (4).

FIG. 4 is a front elevation view of the framework showing the first (2A) and second (2B) front vertical supports, first (2C) and second (2D) rear vertical supports, front horizontal support (3) and rear horizontal support (4). The rear horizontal support (4) can be straight, or the mid-section can be elevated in the vertical plane, as shown in FIG. 4, to provide a niche to aid the second player in taking the desired position.

Figure 5:
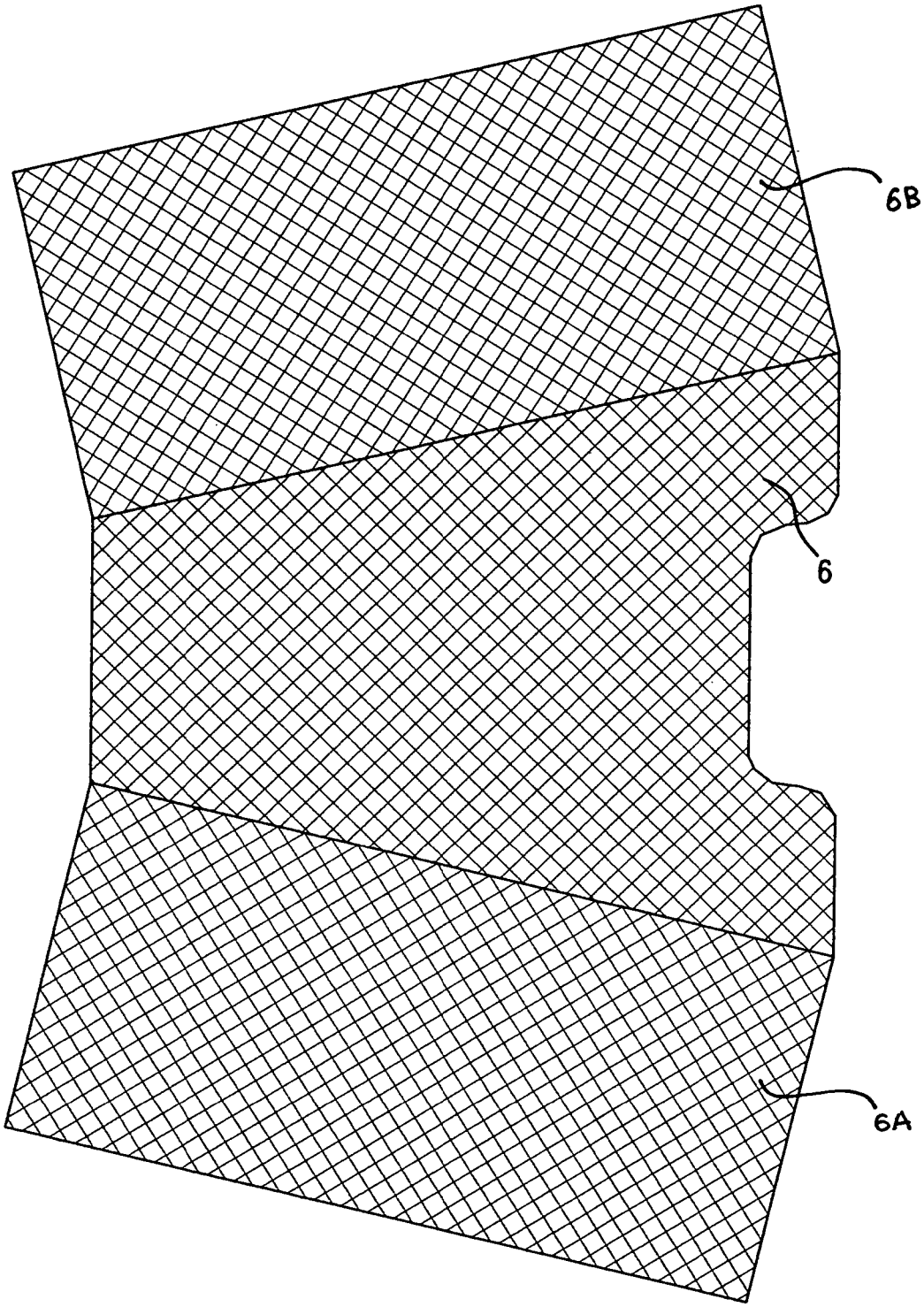
FIG. 5 is a plan view of the open mesh net cover (6), designed to cover the top and side openings of the framework. The central section of the open mesh net cover is a top panel, designed to cover the top of the framework; the first (6A) and second (6B) side panels of the net cover are designed to cover the first and second sides of the framework.

FIG. 5 shows, in its extended form, the open mesh net cover (6), designed to cover the top and side openings of the framework. The net cover (6) is designed to rest on and be supported by the horizontal supports. The central section of the cover is a top panel, designed to cover the top of the framework, and the first (6A) and second (6B) side panels are designed to extend downward essentially to the playing surface.

The device, shown in FIG. 1, includes top and side openings covered by the net cover. The net cover provides immediate feedback to players, coaches and trainers if the pass by the center is so inaccurate as to strike the net cover. The rear opening, framed by the rear vertical supports (2C and 2D) and the rear horizontal support (4), provides a general target area, in which the second player is positioned, with a specific target provided by the hands of the second player.

Optionally, the open mesh net cover can be designed having the three panels, the top and two side panels, separate and removably joined to permit disassembly for portability.

The open mesh net cover is attached to the framework by removable means, to provide essentially complete coverage of the top and side openings, so that a football pass directed to any part of the top or side openings will be deflected. The attachments of the open mesh net cover to the framework can be removed, so that the device can be disassembled to provide for portability.

The vertical and horizontal support rods are rigid and may be of metal or of high-impact plastic.

The angular couplings may be of molded or formed high-impact plastic, or of metal.

The open mesh net cover may be of Nylon®, other flexible elastomeric polymer material, or any strong and flexible material.

The vertical and side horizontal supports may be adjustable in length, adjustments being by means of snap buttons and holes; threaded ring clamps, or other conventional means.

Removable attachments of the cover to the framework may be by means of hook and loop fabric; flexible ties or other conventional means.

The protective caps for the lower ends of the vertical supports may be of rubber or any resilient elastomeric material.

In operation the training device is positioned by the user at a desired location on a playing surface, the player in the role of center grasps a football and takes a position near the midway point of the front opening of the device, facing away from the training device, and holding the football on the playing surface. A second player takes a position near the midway point of the rear opening of the device, facing towards the training device. At a signal from the second player or a coach, the center passes the football through the device, from the front to the back of the device, towards the second player who is positioned near the rear of the device, and who may catch the football. The second player or coach may assess the accuracy, force and trajectory of the football, in regard to accepted criteria in the field. In the event that the passed football strikes the open mesh net or the framework, the player engaged in training for the role of center would receive effective feedback regarding the lack of accuracy of the pass, and the football would remain near the device, reducing the need to retrieve the football from a greater distance.

I claim:

1. A portable football center training aid consisting in combination of:

a rectilinear framework having at least four rigid vertical support rods having upper and lower ends, and having at least four rigid horizontal support rods, including a front and a rear horizontal support rod and at least two side horizontal support rods, said horizontal support rods having first and second ends, removably joined to said upper ends of said vertical support rods, said vertical and horizontal support rods thus forming first and second side openings, front and rear openings, and a top opening;

a flexible cover covering said first and second side openings, and said top opening, said cover being removably attached to said vertical and horizontal supports;

wherein said cover is formed of open mesh netting;

at least four angular couplings;

said upper ends of said vertical support rods and said ends of said first and second horizontal support rods being removably-press fitted into holes formed in said at least four angular couplings to position said support rods at desired angles.

2. A training aid of claim 1, wherein said cover is formed of separate first and second side panels and a top panel, which are removably joined together.

3. A training aid of claim 1, wherein said vertical support rods and said at least two side horizontal support rods are in the form of telescoping rods, said vertical and at least two side horizontal support rods allowing adjustments of a height and length of said rectilinear framework.

4. A training aid of claim 2, wherein said vertical support rods and said at least two side horizontal support rods are in the form of telescoping rods, said vertical and at least two side horizontal support rods allowing adjustments of a height and length of said rectilinear framework.

5. A training aid of claim 1, wherein said removably attached flexible cover is attached to said rectilinear framework by hook and loop material.

6. A training aid of claim 2, wherein said removably attached flexible cover is attached to said rectilinear framework by hook and loop material.

7. A training aid of claim 3, wherein said removably attached flexible cover is attached to said rectilinear framework by hook and loop material.

8. A training aid of claim 1, wherein said lower ends of said vertical support rods include protective caps.

9. A training aid of claim 2, wherein said lower ends of said vertical support rods include protective caps.

10. A training aid of claim 3, wherein said lower ends of said vertical support rods include protective caps.

11. A training aid of claim 4, wherein said lower ends of said vertical support rods include protective caps.

* * * * *